US007245737B2

(12) United States Patent
Amae et al.

(10) Patent No.: US 7,245,737 B2
(45) Date of Patent: Jul. 17, 2007

(54) BEHIND-THE-HEAD MOUNTED PERSONAL AUDIO SET

(75) Inventors: Dominic Amae, Vancouver, WA (US); Jamian Cobbett, Portland, OR (US); Omer Kotzer, Portland, OR (US)

(73) Assignee: Logitech Europe S.A., Romanel-sur-Morges (CH)

( * ) Notice: Subject to any disclaimer, the term of this patent is extended or adjusted under 35 U.S.C. 154(b) by 0 days.

(21) Appl. No.: 10/989,736

(22) Filed: Nov. 15, 2004

(65) Prior Publication Data

US 2005/0226452 A1 Oct. 13, 2005

Related U.S. Application Data

(60) Provisional application No. 60/520,260, filed on Nov. 13, 2003.

(51) Int. Cl.
*H04R 25/00* (2006.01)

(52) U.S. Cl. ..... 381/374; 381/378; 381/379

(58) Field of Classification Search ..... 379/430; 381/374, 375, 376, 378, 384, 370, 379
See application file for complete search history.

(56) References Cited

U.S. PATENT DOCUMENTS 5,457,751 A 10/1995 Such 6,252,970 B1 * 6/2001 Poon et al. ..... 381/374

OTHER PUBLICATIONS

International Search Report; PCT app. No. PCT/US04/38204; Jun. 16, 2006; 3 pages.

Written Opinion of the International Searching Authority; PCT app. No. PCT/US04/38204; Jun. 16, 2006; 7 pages.

Notification of Transmittal of International Search Report and Written Opinion; PCT app. No. PCT/US04/38204; Jun. 16, 2006; 1 page.

International Preliminary Report on Patenability; PCT app. No. PCT/US04/38204; Aug. 17, 2006; 8 pages.

* cited by examiner

*Primary Examiner*—Sinh Tran
*Assistant Examiner*—Brian Ensey
(74) *Attorney, Agent, or Firm*—Ipsolon llp

(57) ABSTRACT

A reversible behind-the-head mounted personal audio set that may be worn on either a wearer's left or right ear is disclosed. The behind-the-head headband occupies a substantially horizontal plane and a headset-mounting portion is pivotally secured to the headband at a first pivot so that the center of the earphone is positioned below the plane of the headband. In one embodiment, a boom microphone is pivotally secured to the headset mounting portion at a second pivot axis spaced apart from said first pivot axis.

15 Claims, 12 Drawing Sheets

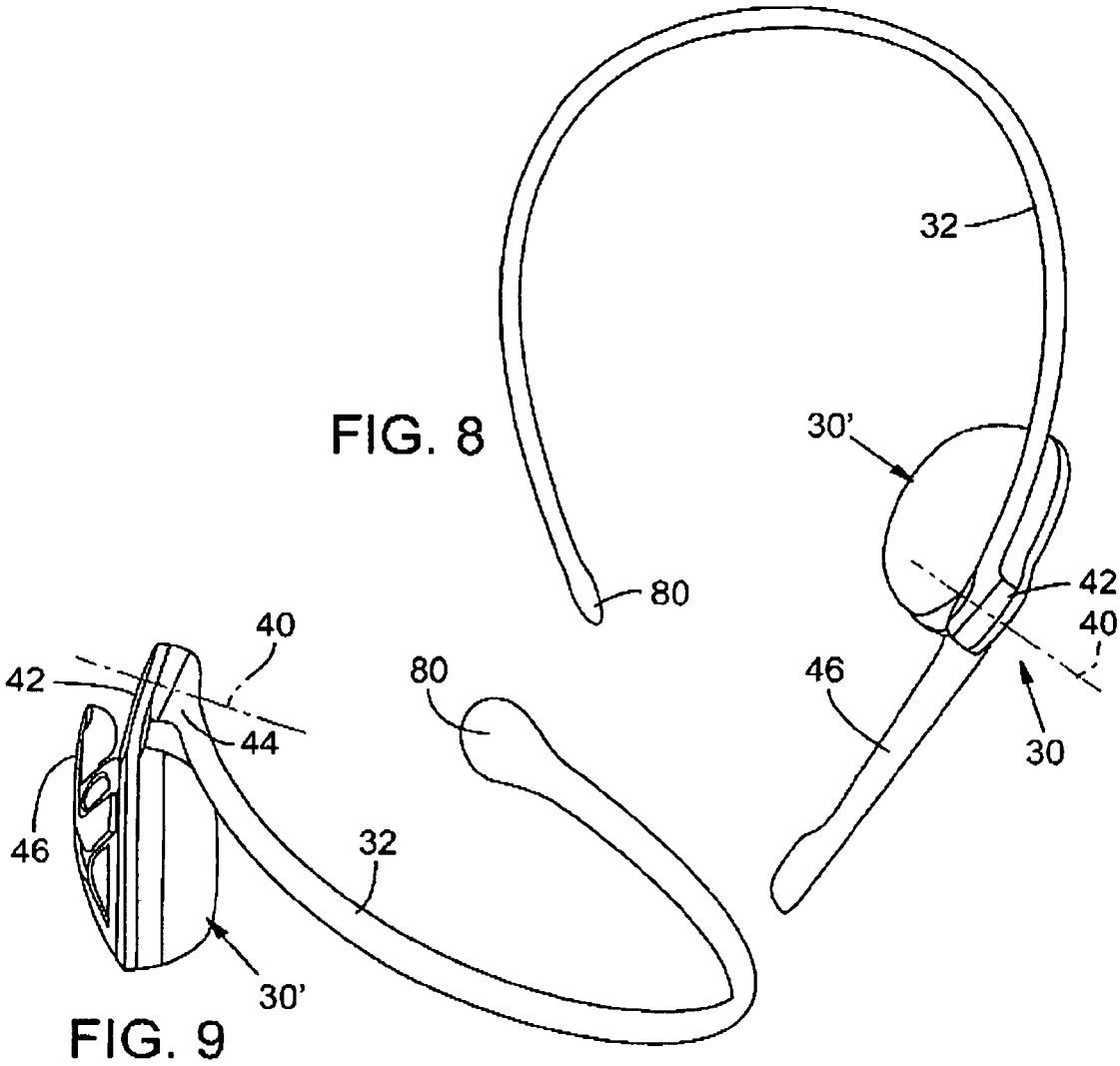
FIG. 8
FIG. 9
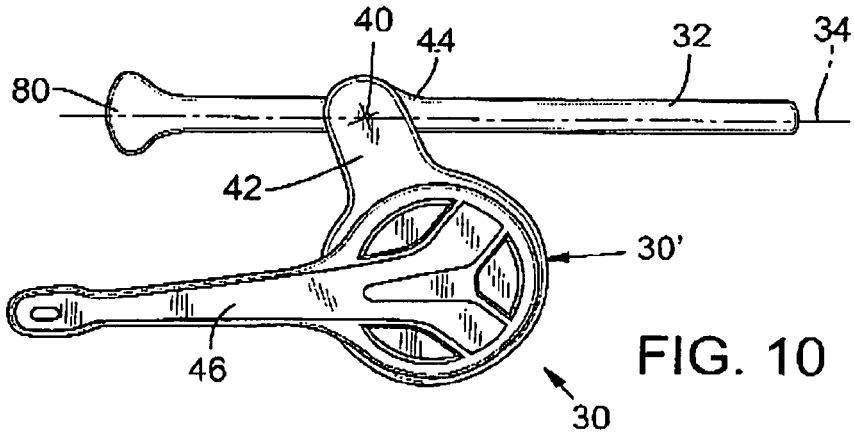
FIG. 10

BEHIND-THE-HEAD MOUNTED PERSONAL AUDIO SET

CROSS REFERENCE TO RELATED APPLICATION

This application claims priority to U.S. Provisional Patent Application Ser. No. 60/520,260, filed on Nov. 13, 2003.

FIELD OF THE INVENTION

The present invention relates to a behind-the-head mounted personal audio.

BACKGROUND OF THE INVENTION

Personal audio-sets, commonly known as headphones, earphones, headsets, and the like, are gaining in popularity. The typical personal audio-set includes a frame containing an earphone that is usually positioned over or in a wearer's ear. In cases where the audio-set is a headset, a microphone is also typically positioned near the wearer's mouth.

One method for detachably securing a personal audio-set to a wearer includes securing the personal audio-set to a headband that encircles the rear portion of the wearer's head. These types of mounting structures are commonly known as "behind-the-head" mounts.

Known behind-the-head mounts have several drawbacks. For example, in cases where they are used with a mono-aural personal audio set or the like, they do not allow a wearer to easily reverse the orientation of the personal audio set such that it may be worn adjacent to either the wearer's left or right ears. This type of reversibility is a desirable characteristic in a personal audio set.

Known behind-the-head mounts for personal audio sets usually require the wearer to detach one or more pieces from the mounting structure and then reattach in a different orientation or location along the mount. In practice, such reversible behind-the-head mounts are difficult to use correctly and tend to wear prematurely due to repeated detaching and reattaching of the mount components. Moreover, individual pieces of the detachable structure are prone to being misplaced or lost, thereby limiting the use of the structure or in some cases rendering the structure useless.

SUMMARY OF THE INVENTION

Accordingly, despite the available behind-the-head mounts for personal audio sets, there remains a need for a light weight, stylish, durable, and economical, mount that allows a mono-aural personal audio device to be worn in either a wearer's left or right ear without the need to remove or detach individual components of the personal audio sent and mount. In addition to other benefits that will become apparent in the following disclosure, the present invention fulfills these needs.

The present invention is a curved headband, preferably occupying a common plane, sized to encircle rear contour of a wearer's head substantially between the wearer's ears. At least one end of the headband includes a first pivot operably securing a headset mounting portion thereto. More preferably, the personal audio set is a headset having a boom microphone extending therefrom. The boom microphone is preferably pivotally secured to the headset mounting portion at a defined second pivot. By pivoting the headset and microphone about the first and second pivots, the headset may be positioned adjacent to either a wearer's left or right ears.

BRIEF DESCRIPTION OF THE DRAWINGS

FIG. 8 is a top plane view of the behind-the-head mounted personal audio set of FIG. 1 showing a defined first angle between the in accordance with an embodiment of the present invention.

FIG. 9 is a back view of the behind-the-head mounted personal audio set of FIG. 1 showing a defined second angle in accordance with an embodiment of the present invention.

FIG. 10 is a right, side view of the behind-the-head mounted personal audio set of FIG. 1 showing a defined third angle in accordance with an embodiment of the present invention.

DETAILED DESCRIPTION OF PREFERRED EMBODIMENTS

Figure 1:
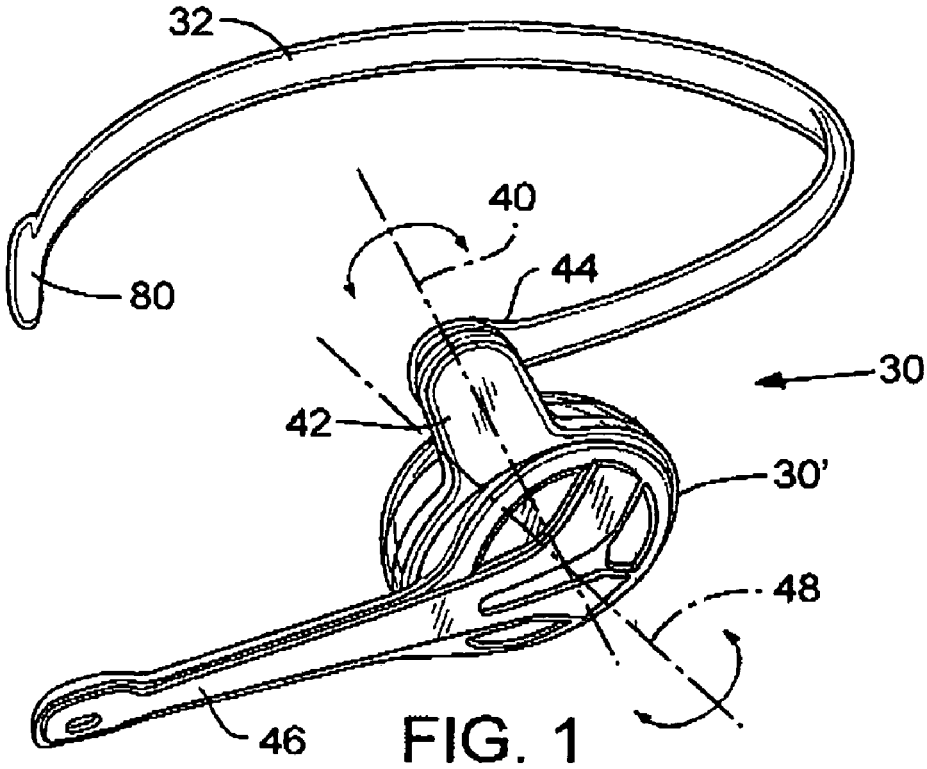
FIG. 1 is a front, left, perspective view of a behind-the-head mounted personal audio set in accordance with an embodiment of the present invention.
Figure 2:
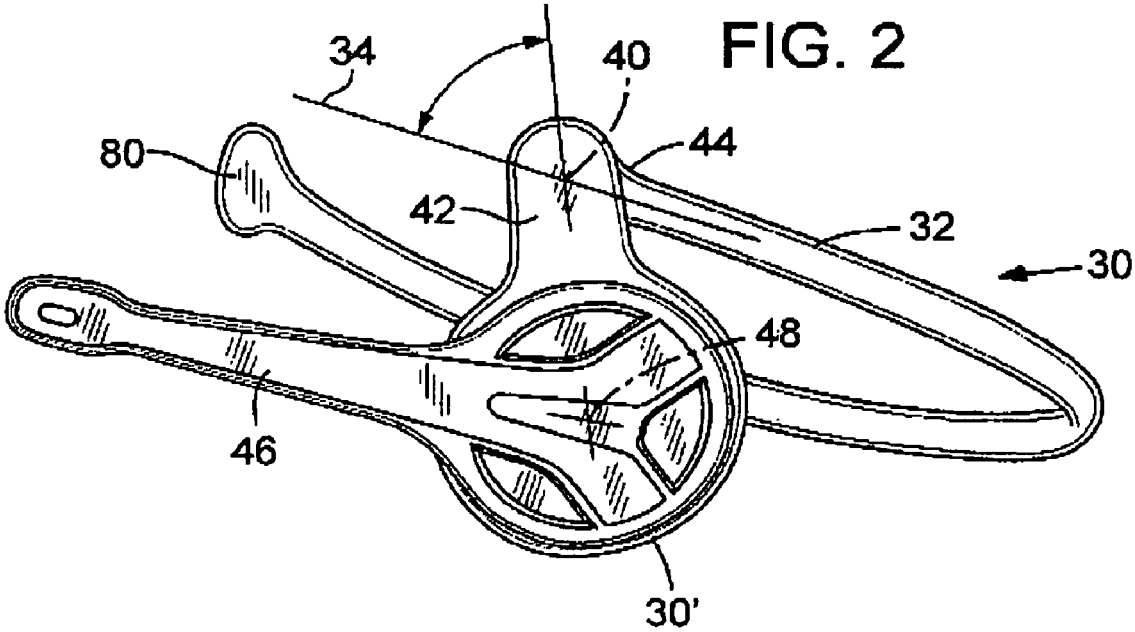
FIG. 2 is a left, elevation view of the behind-the-head mounted personal audio set of FIG. 1.
Figure 3:
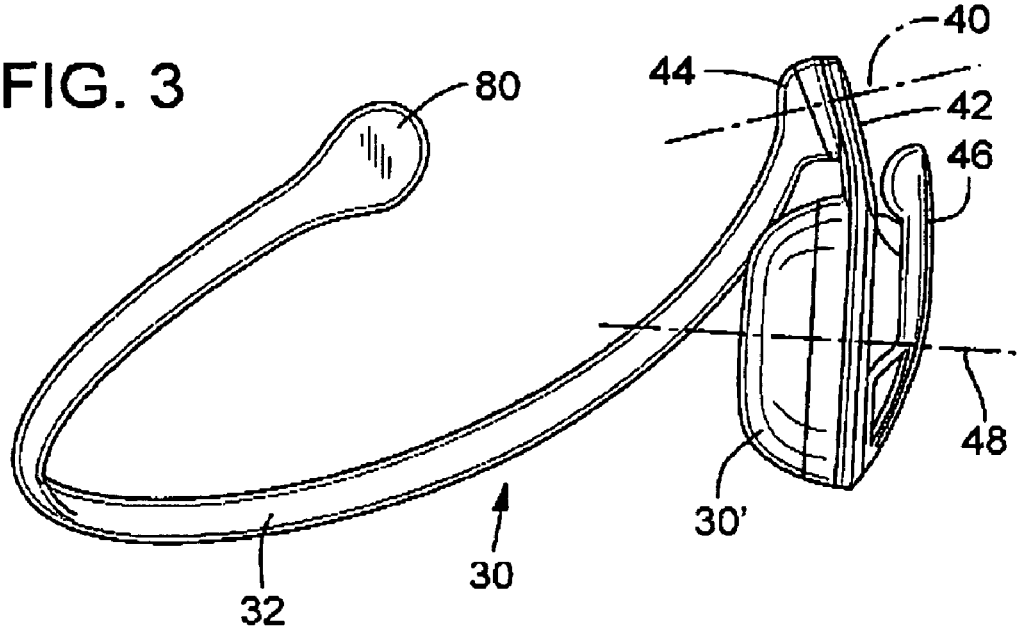
FIG. 3 is a front, elevation view of the behind-the head mounted personal audio set of FIG. 1.
Figure 4:
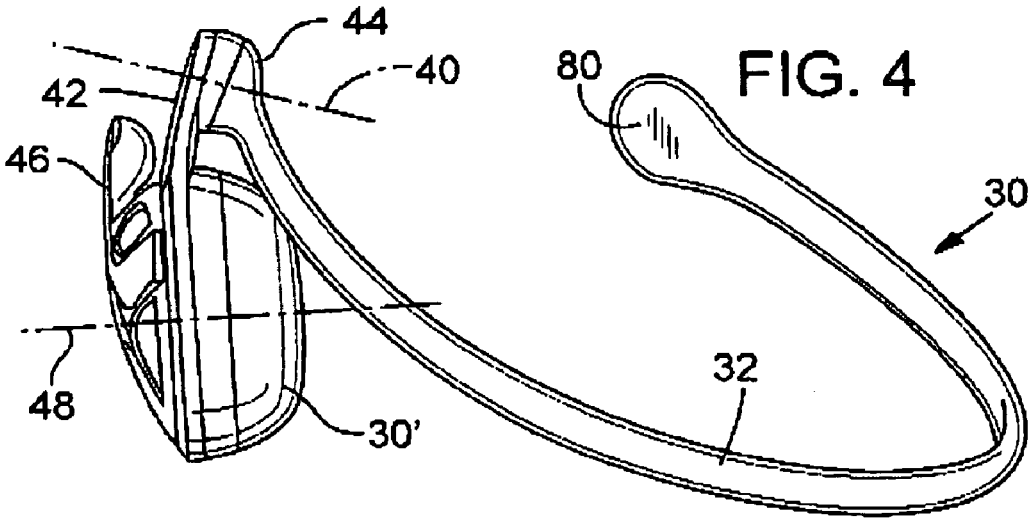
FIG. 4 is a back, elevation of the behind-the-head mounted personal audio set of FIG. 1.
Figure 5:
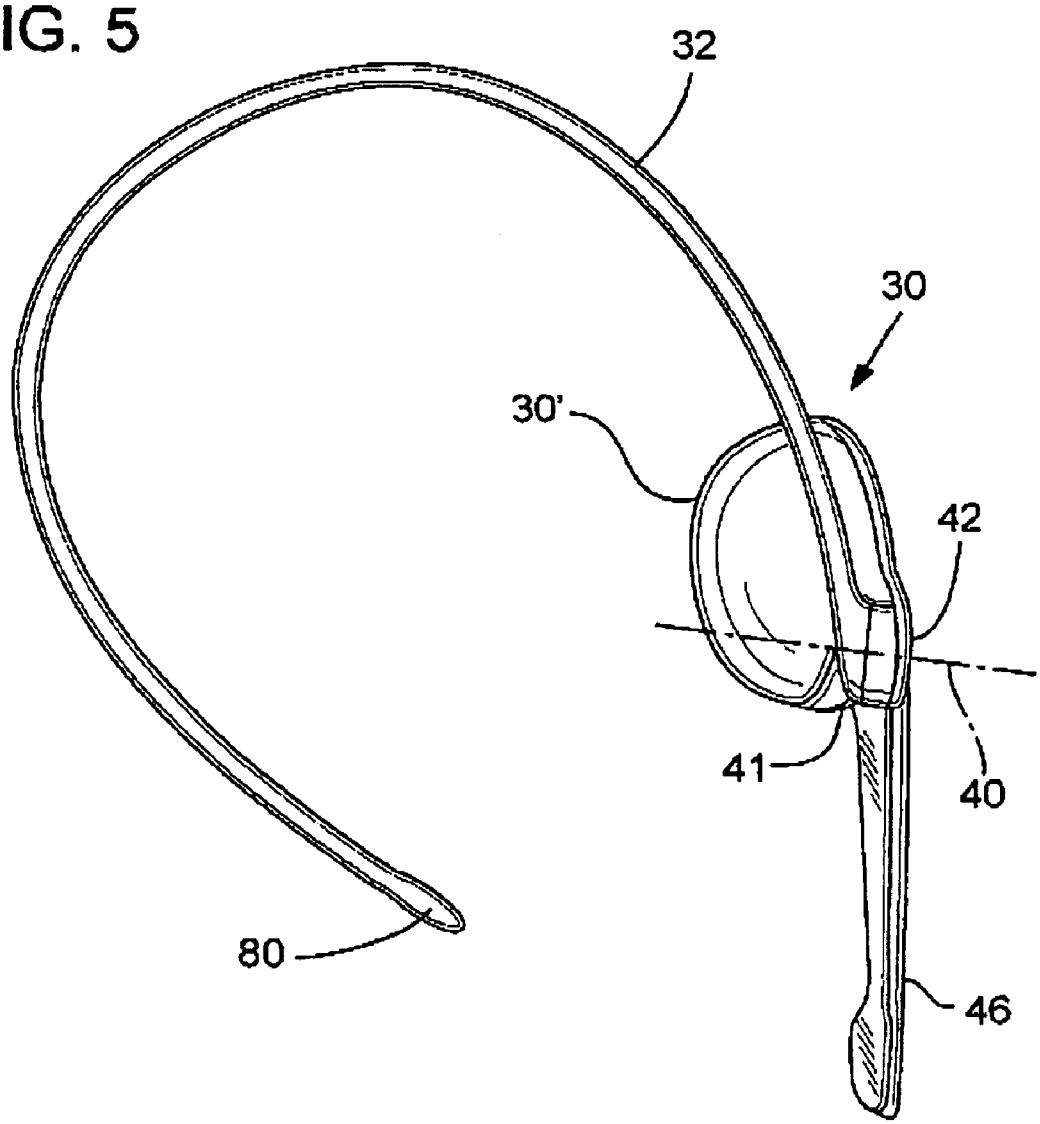
FIG. 5 is a top plan view of the behind-the-head mounted personal audio set of FIG. 1.
Figure 6:
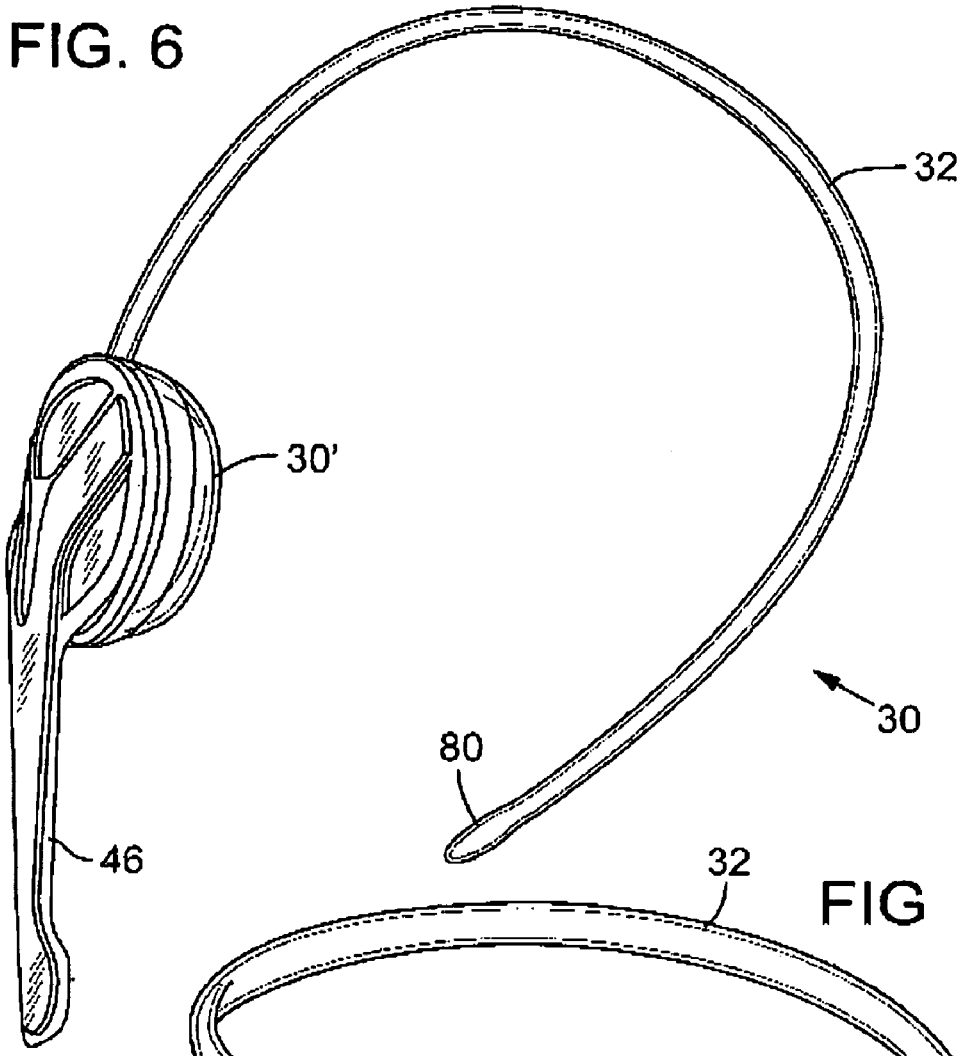
FIG. 6 is a bottom plan view of the behind-the-head mounted personal audio set of FIG. 1.
Figure 7:
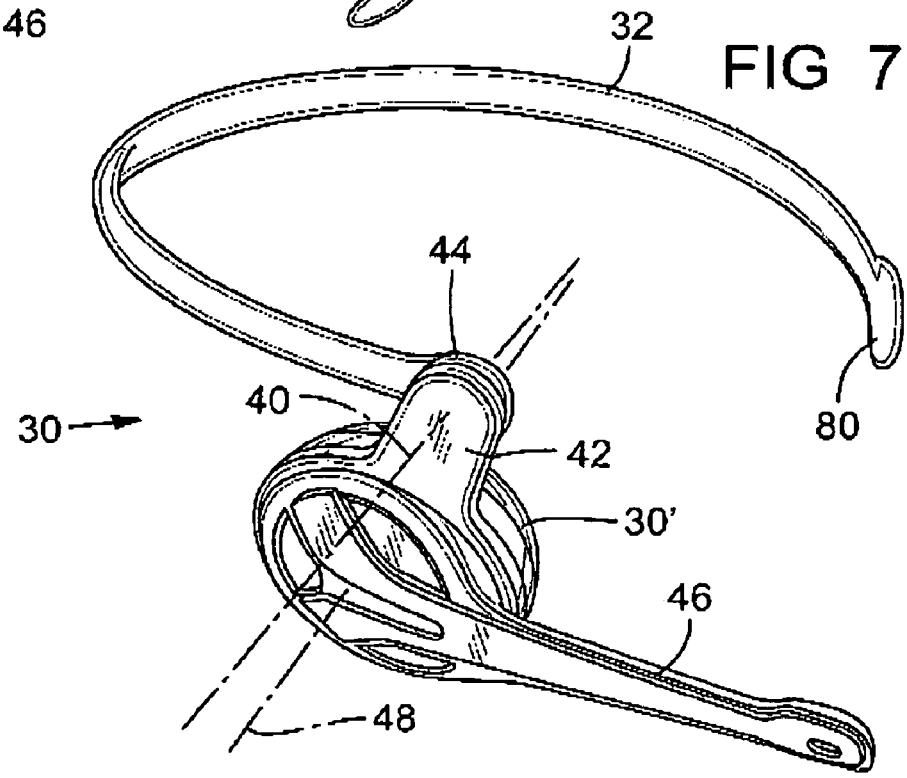
FIG. 7 is a front, right, perspective view of the behind-the-head mounted personal audio set of FIG. 1 showing a second possible orientation such that the audio set may be worn adjacent to a wearer's right ear.

A behind-the-head mounted personal audio set 30 is shown in FIGS. 1-18D.

In a preferred embodiment, the behind-the head mounted personal audio set 30 has a curved headband 32, preferably occupying a common plane 34 as best shown in FIG. 10. As best shown in FIGS. 15A-E, 16A-E, and 17, the headband 32 has a first end 44 and an opposite second end 80, and it is preferably sized to encircle and slightly grasp the rear contour of a wearer's head 36 substantially between the wearer's ears 38*a*, 38*b*.

As shown in FIGS. 1-14B, a first pivot 40 operably securing a headset-mounting portion 42 thereto is positioned toward a first end 44 of the headband 32. Preferably, the headset-mounting portion 42 has an earphone 39 operably secured therein, and the center 41 of the earphone 39 is positioned below the common plane 34 of the headband.

More preferably, the personal audio set 30 is a headset 30' having a boom microphone 46 extending therefrom. The boom microphone 46 is preferably pivotally secured to the headset-mounting portion 42 at a defined second pivot 48. By pivoting the headset 30' and microphone 46 about the first and second pivots 40, 48, the headset 30 may be positioned adjacent to either a wearer's left ear 38*a* as shown in FIGS. 1, 15A-E and 17, or a wearer's right ear 38*b* as shown in FIGS. 7 and 16A-E.

Preferably, the first pivot 40 is aligned along a defined three dimensional angle with respect to the headband 32 so as to optimize wearer comfort. This defined angle is shown as three two-dimensional angles in FIGS. 8-10 and labeled "angle 1" (FIG. 8), "angle 2" (FIG. 9), and "angle 3" (FIG. 10). Preferably, "angle 1", which biases the position of the earphone portion of the audio set to fit the angle of a human ear when viewed from the top of the head is 12 degrees plus or minus 10 degrees. "Angle 2" (FIG. 10), which is the angle between the intersection of the first pivot axis 40 and the second pivot axis 48, is preferably 25 degrees plus or minus 20 degrees and "angle 3", which is the angle between the common plane 34 of the headband 32 and the longitudinal centerline 45 of the headset mounting portion 42, is preferably about 60 degrees plus or minus 30 degrees. More preferably, "angle 3" is about 63 degrees.

More preferably, the first pivot 40 includes a detent mechanism 60 to allow proper alignment when the audio set 30 is positioned for wearing adjacent to either a wearer's left or right ears. Preferably, two detents are provided, one for the left ear position shown in FIGS. 15A-E and one for the right ear position shown in FIGS. 16A-E.

Figure 11:
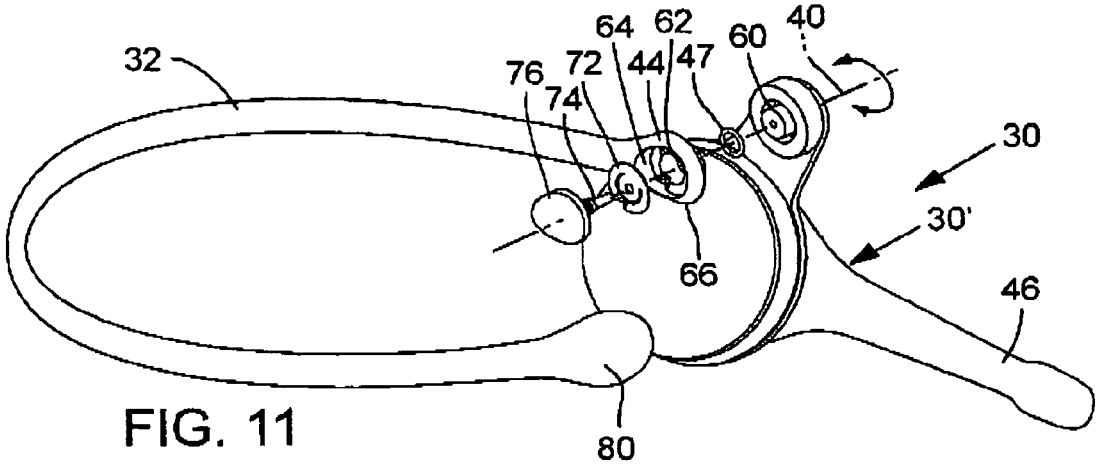
FIG. 11 is a front, left exploded view of the behind-the-head mounted personal audio set revealing possible interior structures forming the first pivot.
Figure 12:
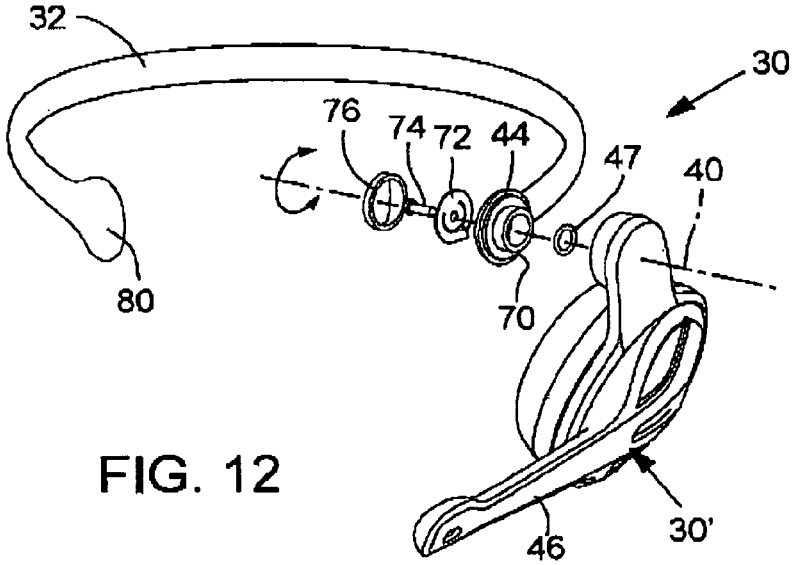
FIG. 12 is a front, right exploded view of the behind-the-head mounted personal audio set of FIG. 11.

One possible pivot structure for the first pivot 40 is shown in FIGS. 11 & 12. The first end 44 of the headband 32 includes a recess 62 defining a cam surface 64. Recesses 66 are placed at defined positions along the cam surface 64 to define the detent positions. The headset mounting portion 42 includes a circular recess 68 sized to rotate about a circular protrusion 70 extending from the first end 44 of the headband 32. Preferably, a resilient o-ring 46 is positioned between the circular recess 68 and the circular protrusion 70 to create frictional holding force. A detent spring 72 is positioned within the recess 62 and secured to the headset mounting portion 42 with a fastener 74. Preferably the detent spring 72 is sized to engage the recesses 66 in the cam surface 64 thereby urging the headset mounting portion 42 to one of the defined detents. More preferably, a cover 76 covers the fastener 74 and detent spring 72.

An alternative pivot structure for the first pivot 40 is shown in FIGS. 18A-D. The first end 44 of the headband 32 includes a cam surface 64. Recesses 65 on the cam surface 64 define the detents. A detent contact 71 is slidably secured to the headset-mounting portion 42 and biased to engage the cam surface 64.

Figure 13:
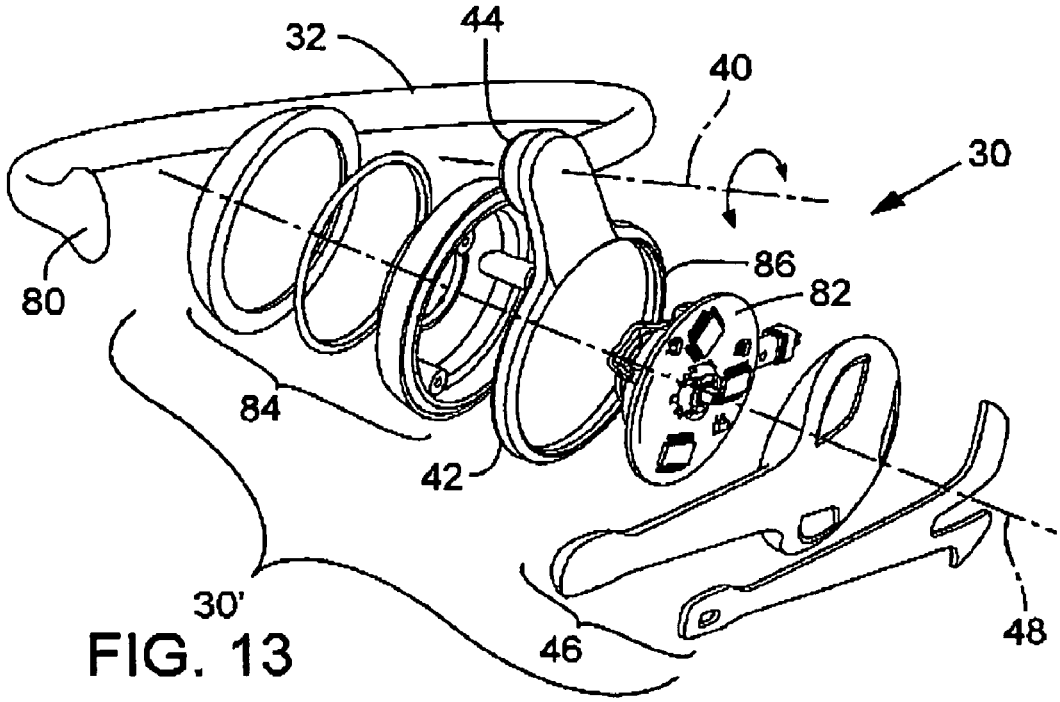
FIG. 13 is a front, exploded view of the behind-the-head mounted personal audio set revealing possible interior structures forming the second pivot.
Figure 14A:
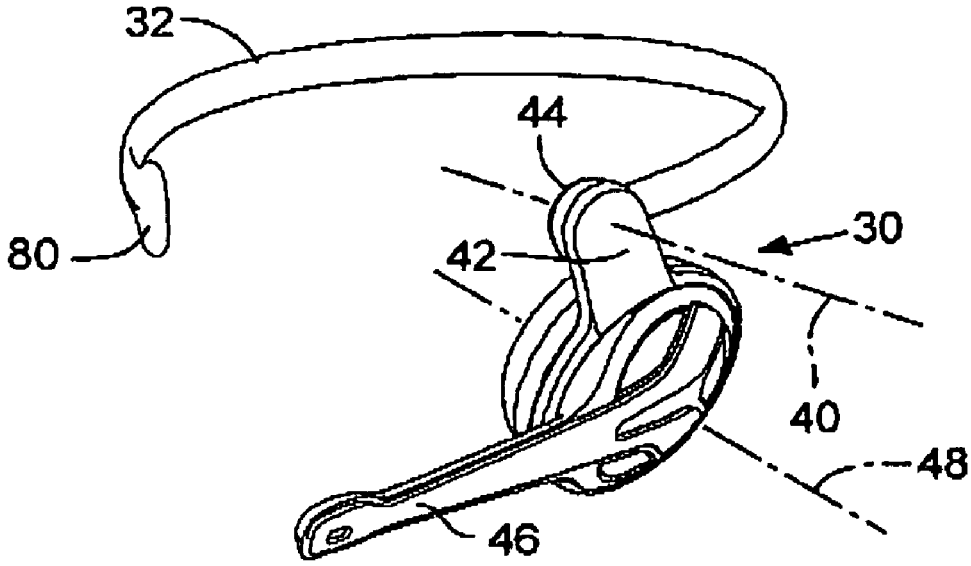
FIG. 14A is a front, right perspective view of the behind-the-head mounted personal audio set in accordance with an embodiment of the present invention.
Figure 14B:
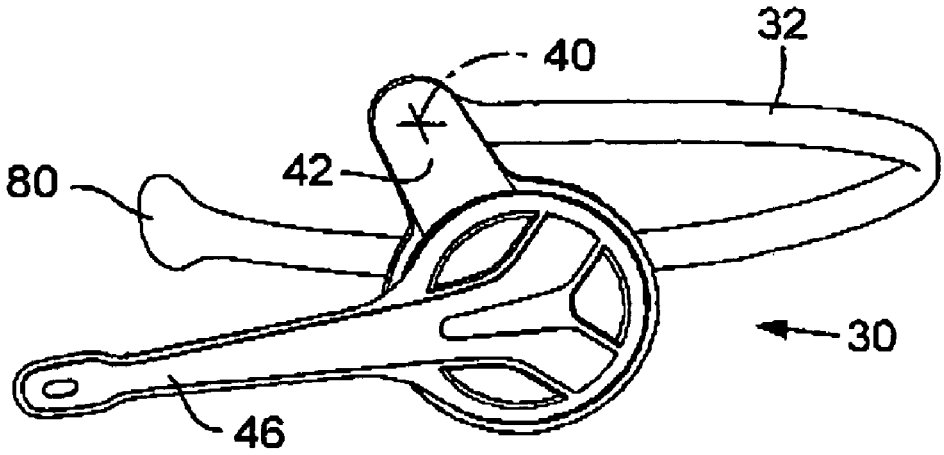
FIG. 14B is a right, side view of the behind-the-head mounted personal audio set of FIG. 14A.
Figure 15A:
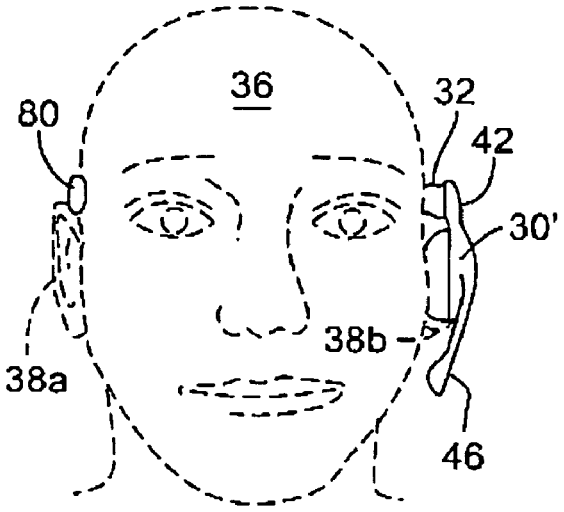
FIGS. 15A-E are various views of the behind-the-head mounted personal audio set of FIG. 1 showing a possible orientation worn on a wearer's left ear.
Figure 15B:
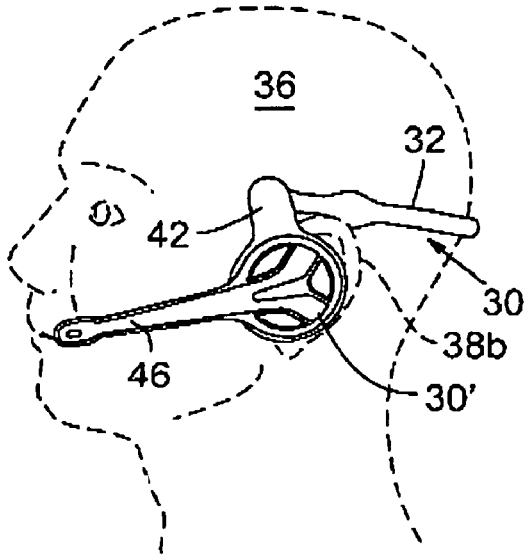
Figure 15C:
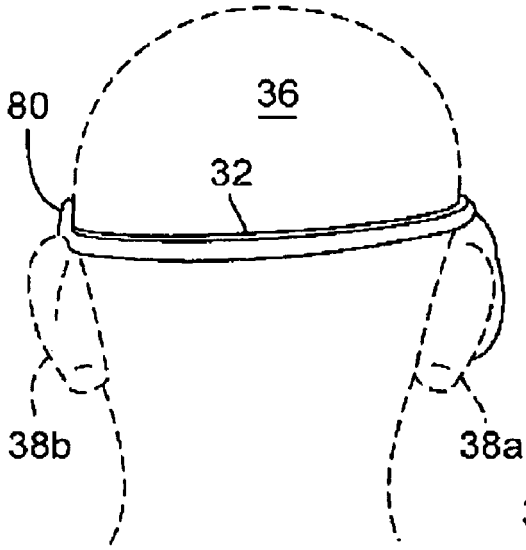
Figure 15D:
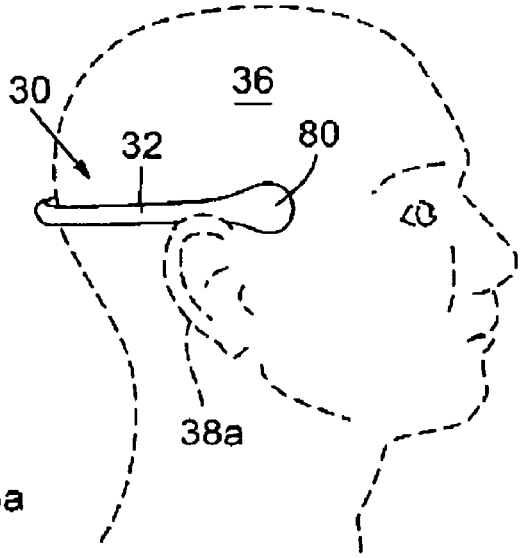
Figure 15E:
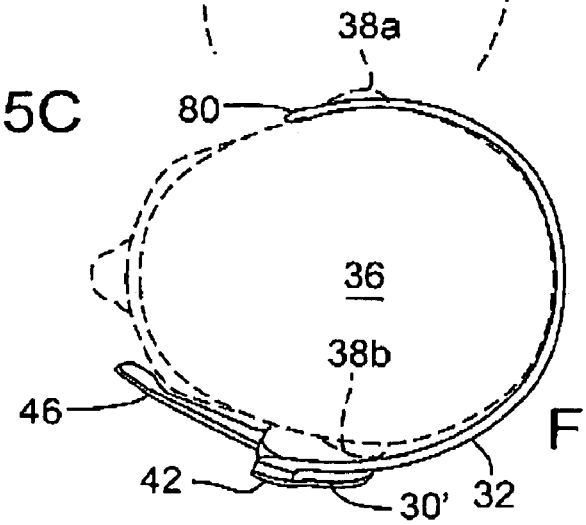
Figure 16A:
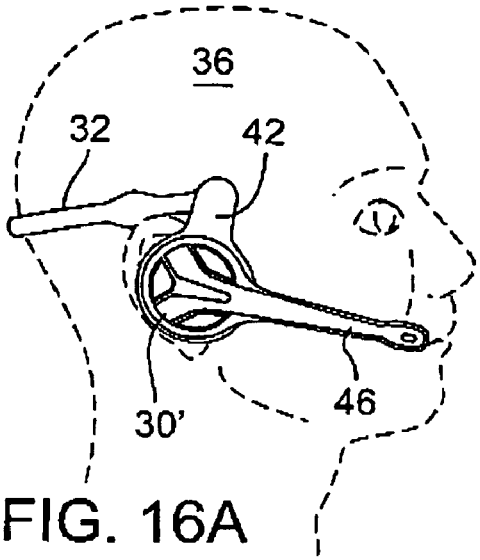
FIGS. 16A-E are various views of the behind-the-head mounted personal audio set of FIG. 1 showing a possible orientation worn on a wearer's right ear.
Figure 16B:
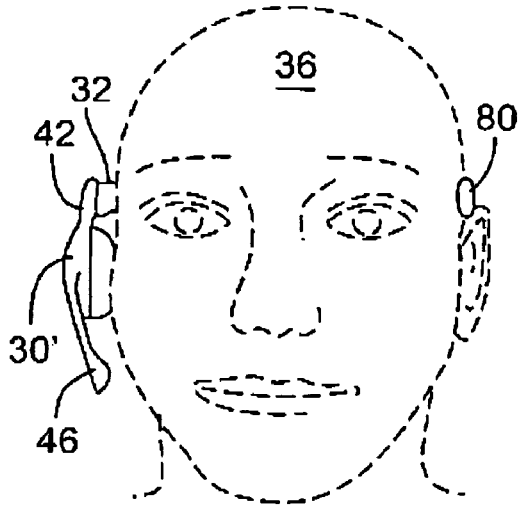
Figure 16C:
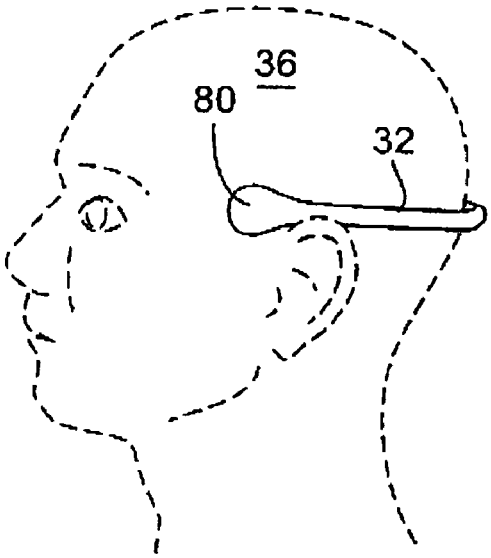
Figure 16D:
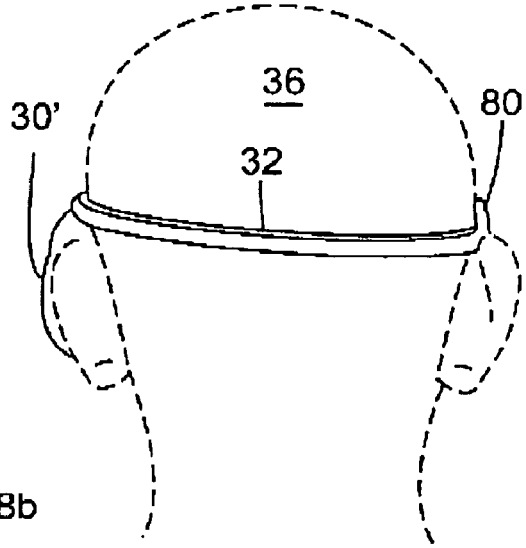
Figure 16E:
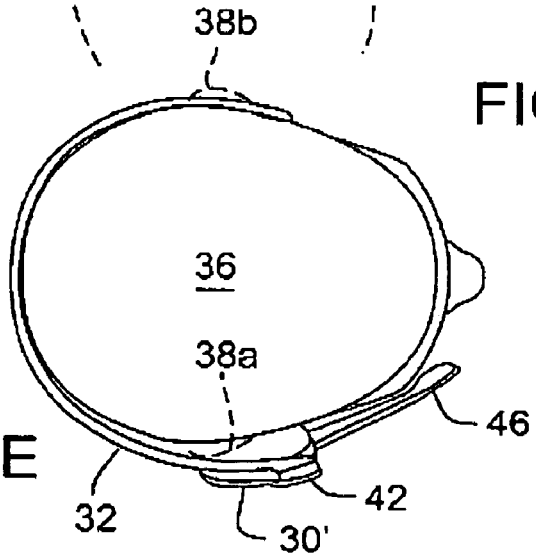
Figure 17:
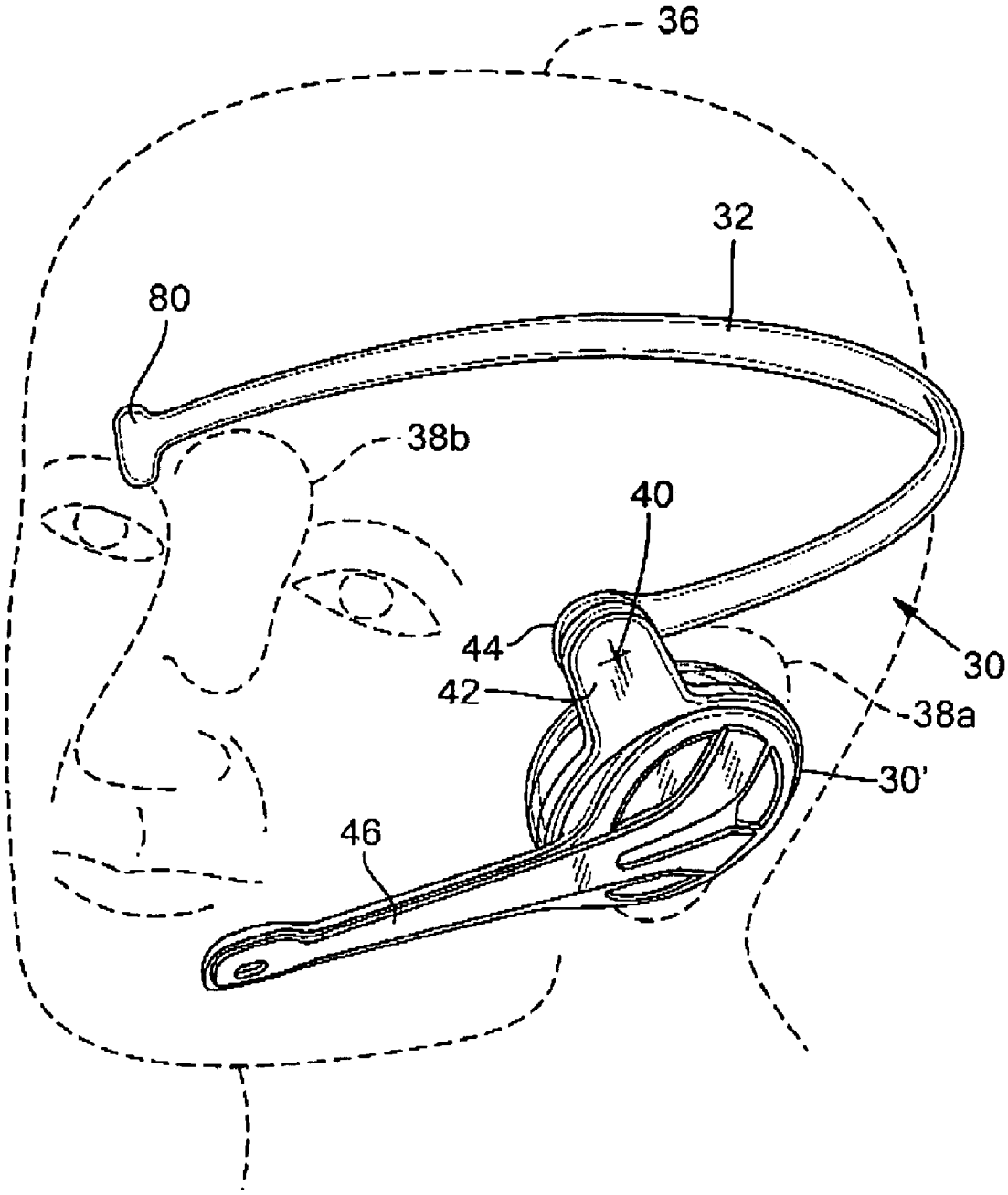
FIG. 17 is a perspective view of the behind-the-head mounted personal audio set of FIG. 1 showing a possible orientation on a wearer's left ear in hidden lines.
Figure 18A:
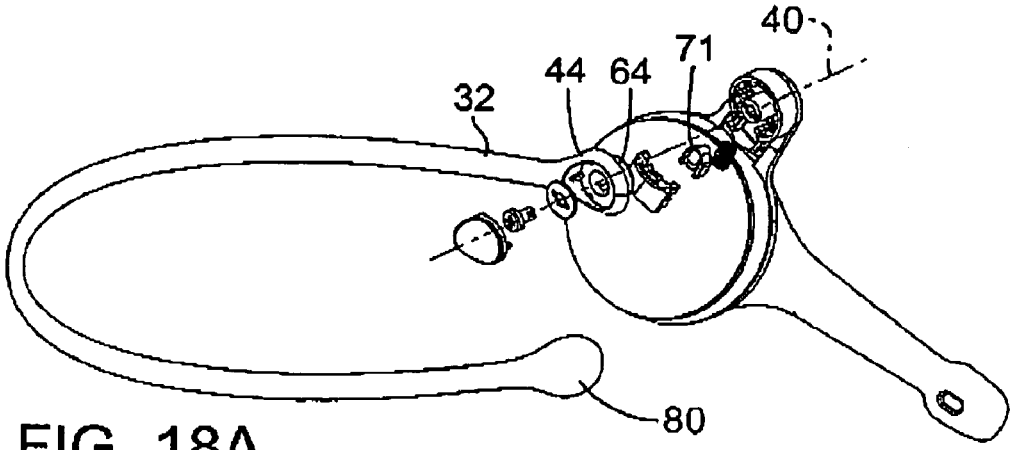
FIG. 18A is a right, front exploded view of an alternative possible first pivot structure.
Figure 18B:
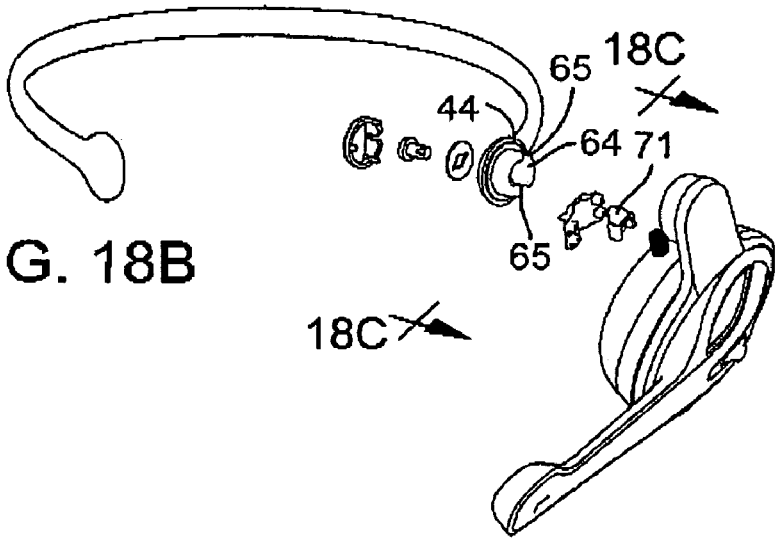
FIG. 18B is a left, front exploded view of the alternative possible first pivot structure of FIG. 18A.
Figure 18C:
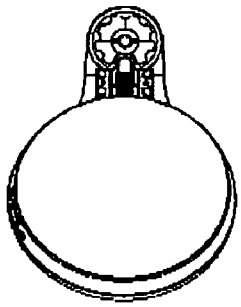
FIG. 18C is a view of a portion of the alternative possible first pivot structure taken along lines 18C-18C of FIG. 18B.
Figure 18D:
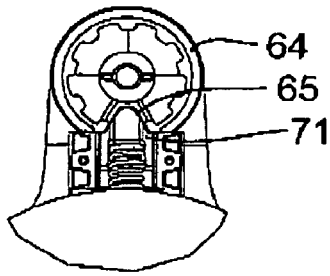
FIG. 18D is an enlarged view of the portion of the alternative possible first pivot structure of FIG. 18C.

A possible pivot structure for the second pivot 48 is shown in FIGS. 13 and 14. The headset mounting portion 42 includes a substantially circular opening 86 about which a headset 30' having a boom microphone 46, operating electronics 82, and an earphone portion 84 attached thereto rotates. Preferably, an o-ring is positioned within the circular opening 86 to hold a desired position of the headset 30'. The personal audio set may be wired or wireless.

It can be appreciated that by securing the electronics 82 within the headset 30' and then pivotally securing the headset 30' to the headset mounting portion 42, a wide variety of different headsets 30' may be secured to the headband 32 without the need to modify or replace any wiring running through the headband or the like.

Having described and illustrated the principles of our invention with reference to a preferred embodiment thereof, it will be apparent that the invention can be modified in arrangement and detail without departing from such principles. For example, the detailed description has focused on a mono-aural personal audio set being positioned toward one end of the headband. Of course, a second personal audio set can be positioned toward the second, opposite end of the headband, thereby allowing the behind-the-head mount to be used to hold a pair of headphones or the like. In view of the many possible embodiments to which the principles may be put, it should be recognized that the detailed embodiment is illustrative only and should not be taken as limiting the scope of our invention. Accordingly, we claim as our invention all such modifications as may come within the scope and spirit of the following claims and equivalents thereto.

We claim:

1. A personal audio device having:

a behind-the-head headband having a longitudinal centerline occupying a substantially horizontal plane;

an elongate headset mounting portion pivotally secured to the headband at a first pivot; and, an earphone secured to the elongate headset mounting portion, said earphone having a center, said center positioned below the substantially horizontal plane of the headband.

whereby said headset-mounting portion is configured to be pivoted about said first pivot such that said earphone is configured to be positioned over either a wearer's left or right ears when said behind-the-head headband is positioned on the head of said wearer.

2. The personal audio device of claim 1, wherein said elongate headset mounting portion defines a mounting portion longitudinal center line, and said mounting portion longitudinal center line intersects said first pivot.

3. The personal audio device of claim 2, wherein said substantially horizontal plane intersects said first pivot thereby defining a first angle between said substantially horizontal plane and said mounting portion longitudinal center line.

4. The personal audio device of claim 3, wherein said first angle is between 30 degrees and 90 degrees, inclusive.

5. The personal audio device of claim 4, wherein said first angle is about 60 degrees.

6. The personal audio device of claim 5, wherein said first angle is 63 degrees.

7. The personal audio device of claim 1, further including a boom microphone pivotally secured to the headset mounting portion defining a second pivot, said second pivot is spaced apart from said first pivot.

8. The personal audio device of claim 7, wherein said first pivot defines a first pivot axis and said second pivot defines a second pivot axis, and said first and second pivot axes intersect each other at a second defined angle.

9. The personal audio device of claim 8, wherein said second defined angle is between 5 degrees and 45 degrees, inclusive.

10. The personal audio device of claim 9, wherein said second defined angle is about 25 degrees.

11. The personal audio device of claim 1, wherein said earphone defines an earphone plane and said first pivot defines a pivot plane substantially perpendicular to said first pivot and said earphone plane intersects said pivot plane at a defined third angle.

12. The personal audio device of claim 11, wherein said defined third angle is between 2 degrees and 22 degrees, inclusive.

13. The personal audio device of claim 12, wherein said defined third angle is about 12 degrees.

14. The personal audio device of claim 3, further including a resistive detent at said defined first angle.

15. The personal audio device of claim 14, further including two resistive detents at defined positions.

* * * * *